US008951150B2

(12) United States Patent
Mace et al.

(10) Patent No.: US 8,951,150 B2
(45) Date of Patent: Feb. 10, 2015

(54) TENNIS RACKET INCLUDING SHOCK-ABSORBER MEANS

(75) Inventors: Pierre Mace, Lyons (FR); Richard Janes, Worcester, MA (US)

(73) Assignee: Babolat VS, Lyons (FR)

( * ) Notice: Subject to any disclaimer, the term of this patent is extended or adjusted under 35 U.S.C. 154(b) by 294 days.

(21) Appl. No.: 13/202,141

(22) PCT Filed: Feb. 18, 2010

(86) PCT No.: PCT/FR2010/050279

§ 371 (c)(1),
(2), (4) Date: Sep. 15, 2011

(87) PCT Pub. No.: WO2010/094894

PCT Pub. Date: Aug. 26, 2010

(65) Prior Publication Data

US 2011/0319206 A1 Dec. 29, 2011

(30) Foreign Application Priority Data

Feb. 19, 2009 (FR) ..... 09 51078

(51) Int. Cl.
*A63B 49/02* (2006.01)
*A63B 59/00* (2006.01)

(52) U.S. Cl.
CPC ..... *A63B 49/0294* (2013.01); *A63B 59/0092* (2013.01)
USPC ..... 473/522; 473/520; 473/521; 473/539

(58) Field of Classification Search
CPC ... A63B 49/00; A63B 49/002; A63B 59/0092
USPC ..... 473/520–522, 539
See application file for complete search history.

(56) References Cited

U.S. PATENT DOCUMENTS

| | | | | |
|---|---|---|---|---|
| 4,983,242 | A * | 1/1991 | Reed | 156/172 |
| 5,098,098 | A * | 3/1992 | Petralia | 473/521 |
| 5,409,215 | A * | 4/1995 | You | 473/521 |
| 5,413,335 | A | 5/1995 | Braun | |
| 5,458,331 | A | 10/1995 | Bothwell | |
| 5,944,625 | A | 8/1999 | Janes | |
| 6,503,161 | B2 * | 1/2003 | Bothwell | 473/540 |
| 6,530,851 | B2 * | 3/2003 | Munster | 473/521 |
| 6,537,164 | B1 * | 3/2003 | Hsu | 473/521 |
| 6,565,463 | B2 * | 5/2003 | Pai | 473/521 |
| 6,663,515 | B1 * | 12/2003 | Pai | 473/521 |
| 6,966,855 | B2 * | 11/2005 | Yu | 473/521 |
| 7,297,080 | B2 * | 11/2007 | Severa et al. | 473/536 |

(Continued)

FOREIGN PATENT DOCUMENTS

| | | |
|---|---|---|
| DE | 4110698 A1 | 10/1992 |
| JP | 2003-310802 | 11/2003 |

*Primary Examiner* — Raleigh W Chiu
(74) *Attorney, Agent, or Firm* — Dowell & Dowell, PC

(57) ABSTRACT

The racket includes a handle (2) and a frame (4) defined by an inner frame (40) and an outer frame (42), said frame further including shock-absorbing means (50) positioned between the peripheral outer surface of the inner frame and the peripheral inner surface of the outer frame. The frame further includes at least one fitting member (60) having an elongate body (62) and extending against the outer surface of the outer frame (42), and at least one tube (66) for passing a string yarn (10, 12), extending both in first openings (40") formed in the inner frame and in second openings (42") formed in the outer frame.

12 Claims, 5 Drawing Sheets

(56) References Cited

U.S. PATENT DOCUMENTS 7,691,016 B2 * 4/2010 Ashino ..... 473/522
2003/0060312 A1 * 3/2003 Pai ..... 473/521
2009/0082142 A1 * 3/2009 Yu ..... 473/522
2011/0319206 A1 * 12/2011 Mace et al. ..... 473/522

* cited by examiner

TENNIS RACKET INCLUDING SHOCK-ABSORBER MEANS

The present invention relates to a tennis racket including shock-absorber means.

A standard tennis racket includes a handle, a frame, and two divergent branches connecting the handle and the frame. Such a racket may be strung by stretching strings around the frame.

The invention aims to propose a tennis racket that provides an alternative to known solutions. It aims in particular to propose a racket that is improved in terms of shock absorption and/or distribution of hitting power.

To this end, it provides a tennis racket including a handle, a frame, and two branches connecting the handle and the frame, characterized in that the frame includes an inner frame, an outer frame, and shock-absorber means disposed between the outer peripheral face of the inner frame and the inner peripheral face of the outer frame. The frame further includes at least one grommet strip including an elongate body intended to lie against the outer face of the outer frame and at least one grommet through which there passes a string that enters both first orifices provided in the inner frame and second orifices provided in the outer frame.

According to other advantageous but optional features of the invention, taken separately or in any technically feasible combination:

- the inner frame is at a distance from the outer frame so that the inner frame and the outer frame are not in direct contact;
- the inner frame and/or the outer frame is tubular;
- both the inner frame and the outer frame are tubular;
- the inner frame is produced in one piece with the handle and the outer frame is a cover strip at the outer periphery of the inner frame;
- the outer cover strip is symmetrical relative to the head of the frame over more than half the strings inside it;
- each free end of the cover strip covers the inner frame so that all the horizontal strings to be stretched over the frame cooperate with the inner frame and with the cover strip forming the outer frame;
- each grommet has an outer section close to that of a corresponding orifice provided in the outer frame so as to be a force-fit therein and each grommet has an outer section much smaller than that of a corresponding orifice provided in the inner frame so as to define a functional clearance between the grommet and the walls of this orifice;
- the racket includes different cover strips and/or different shock-absorber means;
- the inner frame has an oval shape and incorporates the bridge of the frame and the outer frame extends from the handle and covers at least a portion of the outer periphery of the oval inner frame;
- the outer frame covers the whole of the periphery of the oval inner frame;
- each string has outer dimensions close to the section of a corresponding orifice that is part of the grommet in which said string lies;
- each grommet has a section close to a corresponding orifice provided in the outer frame and a corresponding orifice provided in the inner frame so that the grommet is a force-fit in both of these orifices;
- each grommet has an outer section substantially smaller than the section of a corresponding orifice provided in the outer frame and close to the section of a corresponding orifice provided in the inner frame so that this grommet is a force-fit in the orifice of the inner frame.

The invention is described below with reference to the appended drawings, which are provided by way of non-limiting example only, and in which.

Figure 1:
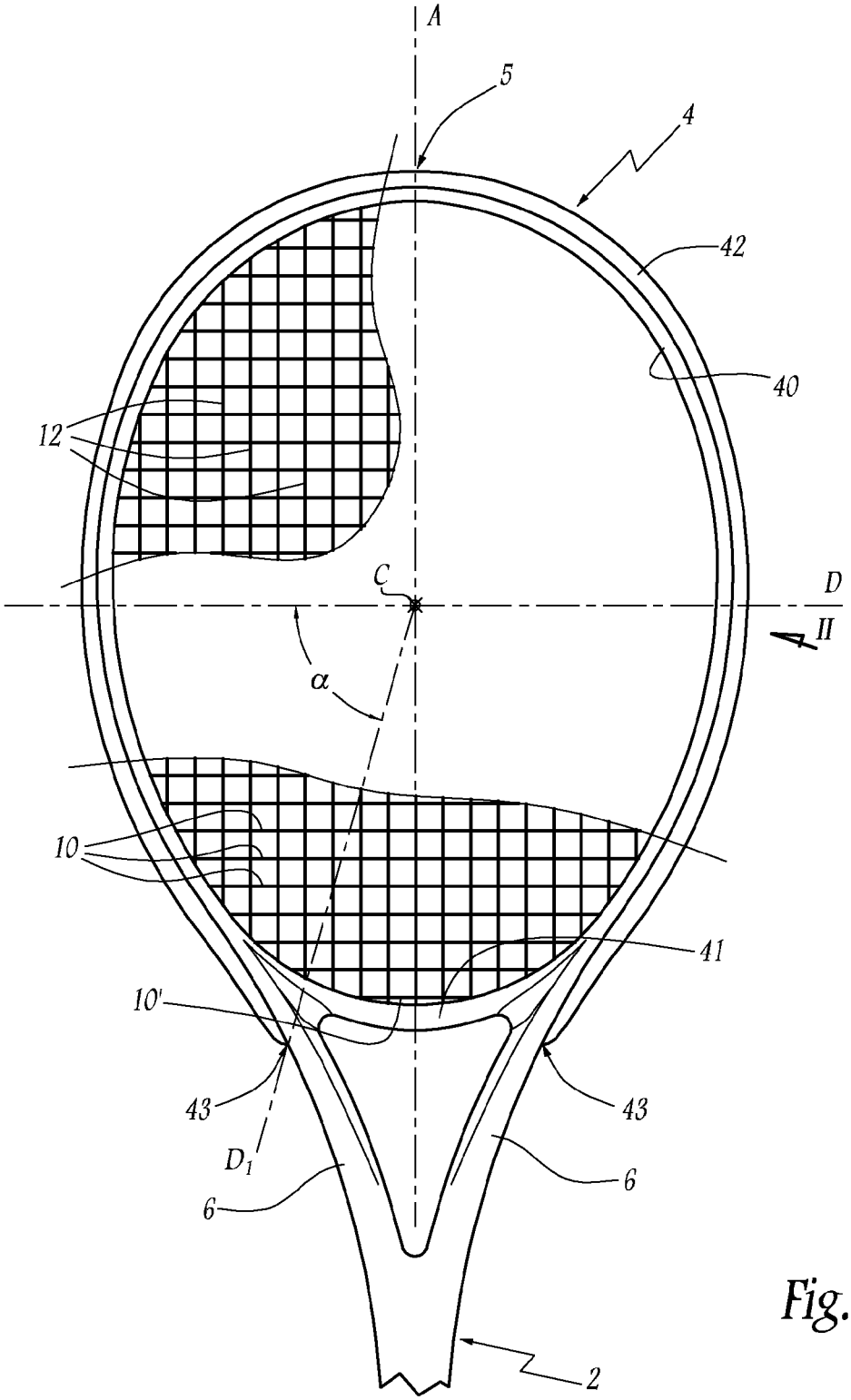
FIGS. 1 and 2 are respectively front and perspective views of a tennis racket of the invention.
Figure 2:
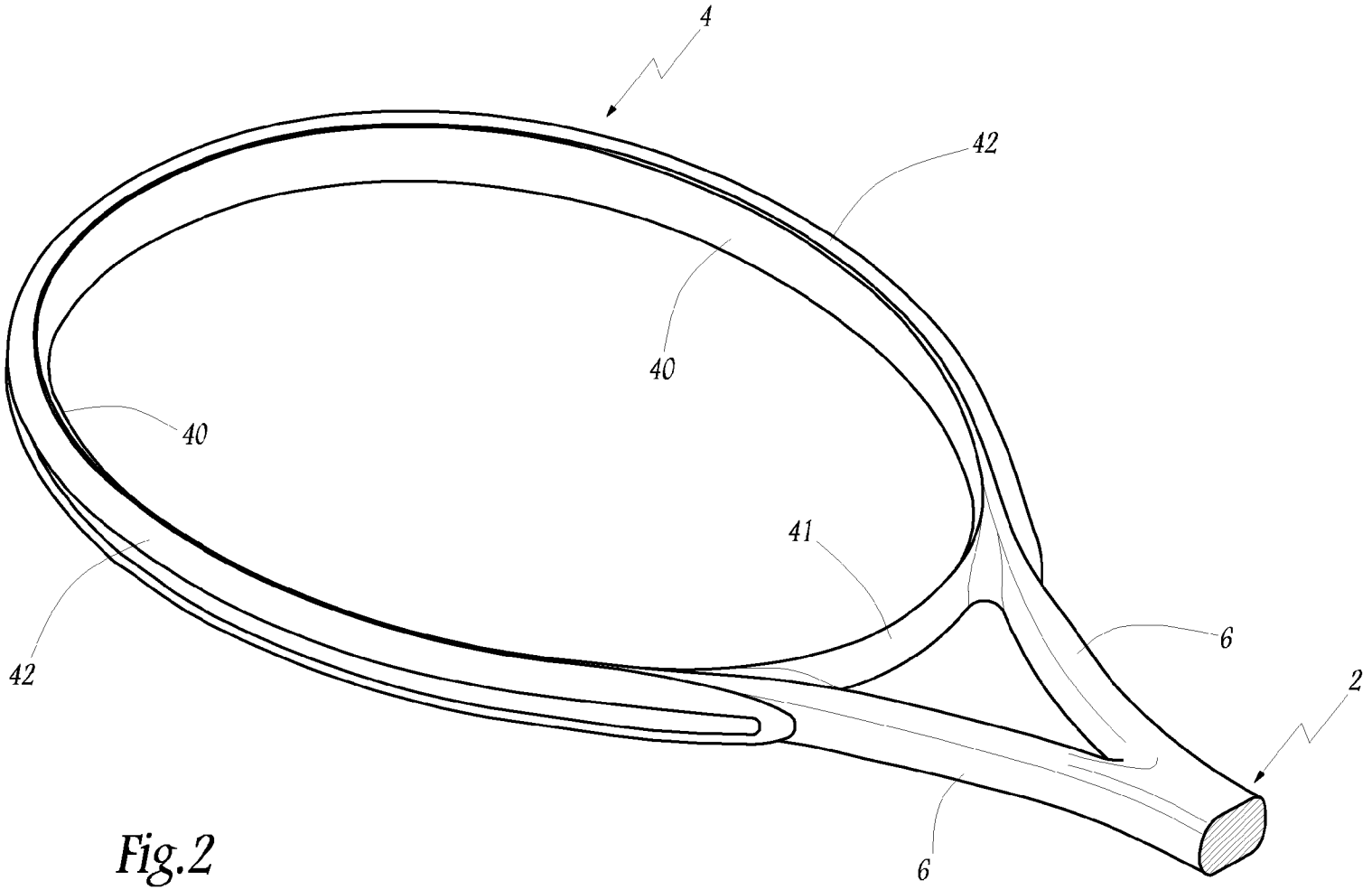
Figure 3:
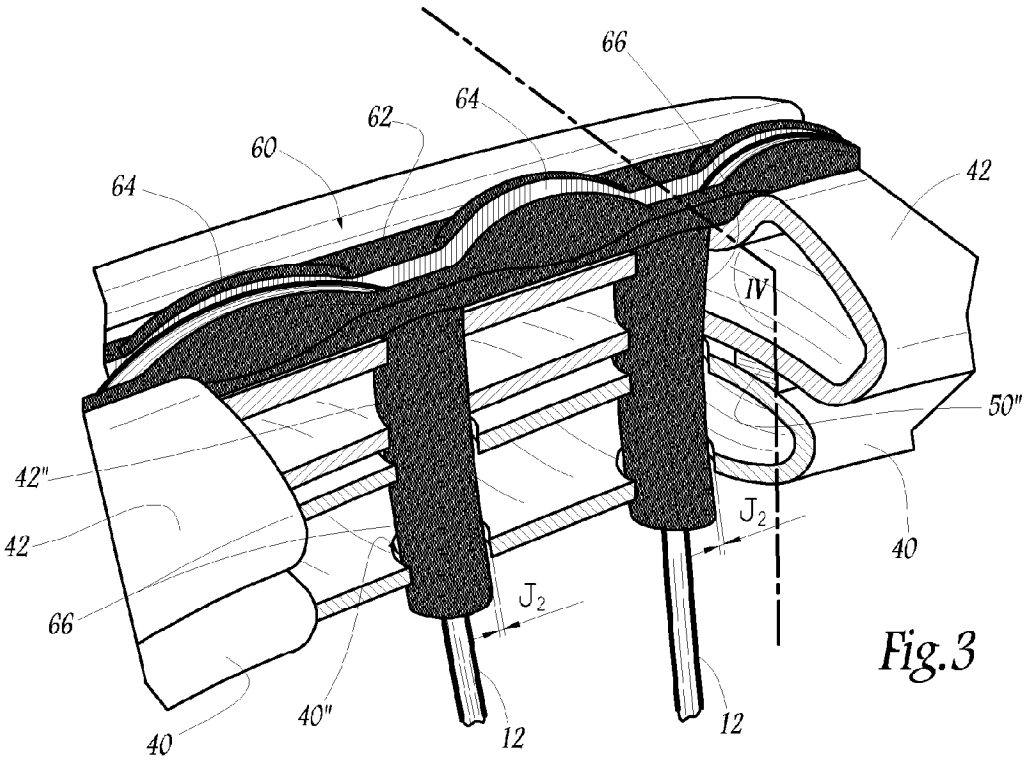
FIG. 3 is a cutaway perspective view showing part of the racket to a larger scale.

The tennis racket shown in FIG. 1 and subsequent figures conforms to a first embodiment of the invention. In the standard manner it includes a handle 2, shown in part, and a frame 4 inside which interwoven horizontal strings 10 and vertical strings 12 are stretched. Two connecting branches 6 diverge from the handle 2 toward the frame 4.

The frame 4 has an inner part and an outer part, which are referred to below as the inner frame 40 and the outer frame 42. The inner frame 40 is made in one piece with the branches 6. To be more precise, the assembly formed by the handle, the two branches and the inner frame is fabricated in a manner known in itself, for example. This assembly may be produced in any appropriate material usually employed for the manufacture of tennis rackets, such as aluminum or a composite material.

To this end a preform comprising the various components of the racket is first produced, for example, and is then placed in a mold. The finished racket is then obtained following the usual blow molding and curing operations. To clarify the description, a few geometrical definitions of the racket are given below, with reference to the drawings. In the drawings, note firstly the main axis A of the racket, which corresponds to that of the handle and consequently is vertical when the racket is resting on the end of the handle. Note also the middle transverse straight line D perpendicular to the axis A passing through the area in which the frame 4 is widest. Finally, note the center C of the racket, which corresponds to the intersection between the main axis A and the middle transverse straight line D.

The outer frame 42, which is horseshoe-shaped when seen from the front, constitutes a cover strip covering part of the inner frame 40. Once in position, this outer frame is symmetrical relative to the head 5 of the racket over an angular sector exceeding 180°. In other words, the free ends 43 of this cover strip lie below the straight line D.

The inner frame 40 is tubular in the sense that, over the greater part of its length, it has a hollow section defined by a closed outline. The outer frame 42 is likewise tubular.

The cover strip preferably extends beyond the lowest horizontal string 10'. In this way, all the horizontal strings can be wound around the outer frame 42, by means of grommet strips described in more detail below. The angle $\alpha$ between the straight line $D_1$ connecting the center C and each end 43 and the above-mentioned straight line D is advantageously greater than 45°, preferably greater than 60°.

Figure 4:
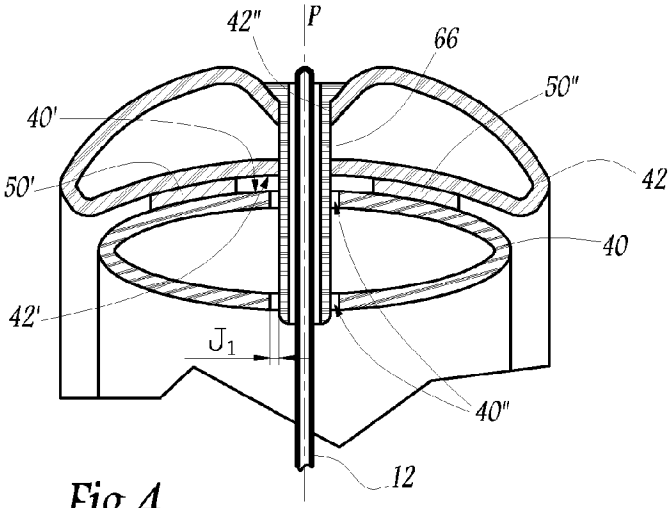
FIG. 4 is a view in cross-section in the plane IV in FIG. 3.
Figure 5:
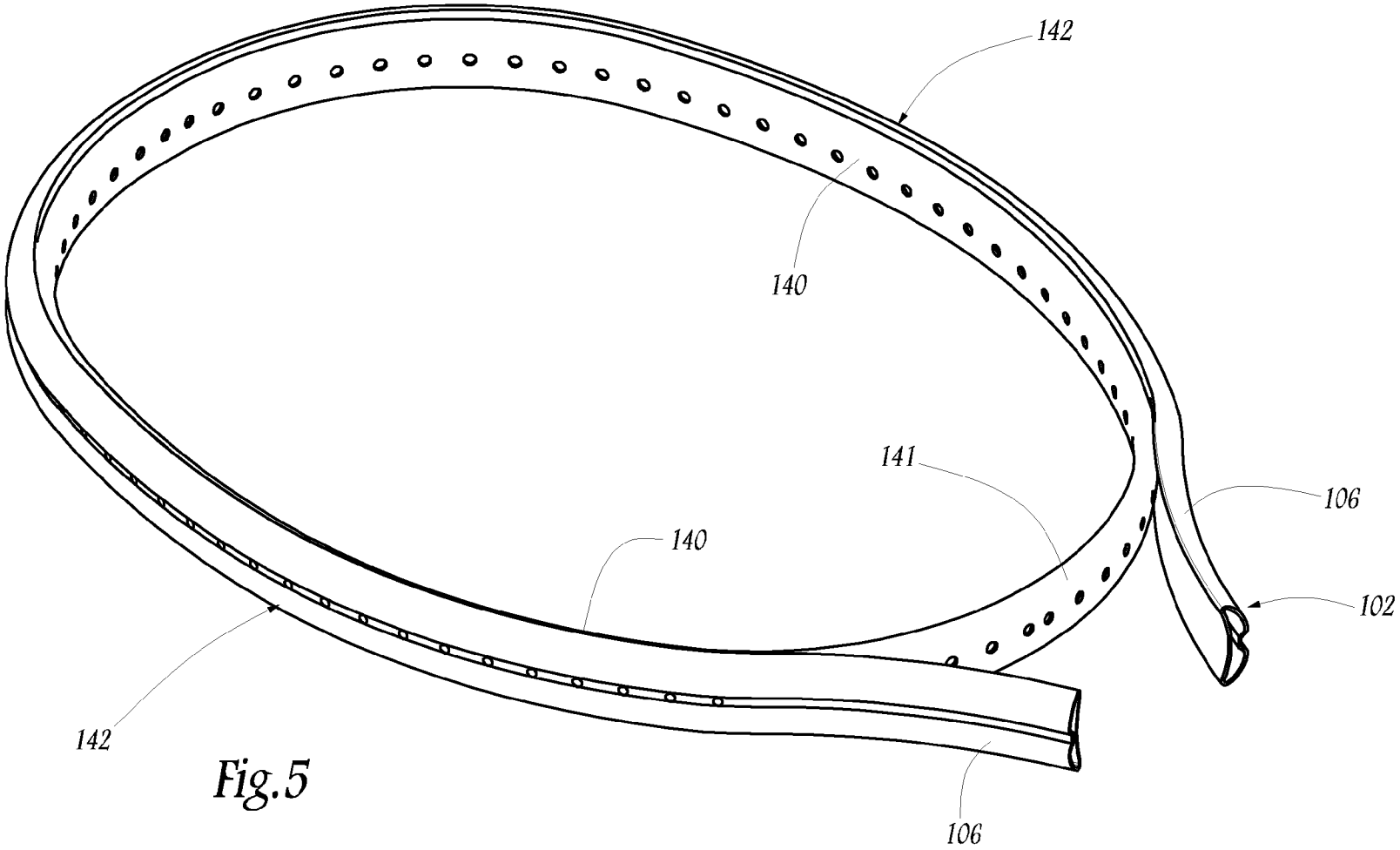
FIG. 5 is a perspective view showing a tennis racket of another embodiment of the invention.

The inner frame 40 has an outer face 40' and the outer frame 42 has an inner face 42'. According to the invention, shock-absorber means are disposed between these two facing faces, as shown in FIG. 4 in particular.

In the example shown, these shock-absorber means are formed by a plurality of elastomer material blocks regularly distributed along the facing faces 40' and 42'. However, a single band of elastomer material may alternatively be provided.

The elastomer material of these blocks has the usual characteristics in order to provide the shock-absorbing function. The blocks may be fastened, for example glued, between the facing faces of the inner and outer frames. It is advantageous to fasten each block to the inner frame and/or the outer frame, as this facilitates assembly of the various components of the racket.

Seen in cross-section, there are advantageously two series of blocks 50' and 50", disposed on respective opposite sides of the mid-plane P of the strings, i.e. on respective opposite sides of the grommets of a grommet strip (see below). The blocks 50' and 50" are disposed between the outer face 40' of the inner frame 40 and the inner face 42' of the outer frame 42. Thus the inner frame 40 is at a distance from the outer frame 42 and so the inner frame 40 and the outer frame 42 are not in direct contact. In other words, the inner frame 40 and the outer frame 42 have no surfaces in contact. This enables the blocks 50' and 50" to exercise effectively their anti-vibration and shock-absorbing functions. It should further be noted that, seen in cross-section, the inner frame 40 has the usual oval shape while the outer frame 42 has a kidney bean overall shape so as to confer a maximum dimension on the facing faces 40' and 42'.

The cover strip 42 is made from a material similar to that of the assembly formed by the handle, the two branches, and the inner frame, for example. The method of manufacturing this cover strip may be similar to that for producing this assembly. An alternative that is not shown is for the cover strip to be produced in a different material and/or by a different manufacturing method than the inner frame 40. In particular, the cover strip 42 may be produced by a method other than blow molding such that it has a solid structure.

The racket further includes grommet strips 60, which are similar to those described in FR-A-2 785 194, for example. Each grommet strip, also referred to as a "shank-bearing cleat", includes a body 62 disposed against the outer periphery of the cover strip that defines bearing surfaces 64 for a string 12. This body is extended by grommets 66 that cooperate with the inner and outer frames.

To be more precise, the outer frame 42 is provided with orifices 42" each of which receives a corresponding grommet 66. The cross-section of the orifices is substantially equal to the outer section of the grommets so that they are a force-fit in these orifices 42".

Moreover, the inner frame 40 is provided with orifices 40" each of which receives a corresponding grommet 66. However, unlike the orifices 42", the orifices 40" have a cross-section much larger than the outside diameter of the grommets 66. Consequently, there is no mutual contact between the grommets 66 and the walls of the orifices 40", which defines clearances J1 and J2 in the transverse direction and in the longitudinal direction.

When the ball is hit, the vibrations produced are transferred directly to the outer cover strip, in particular because there is no contact between the inner frame 40 and the grommets 66. The cover strip 42 in turn transmits these vibrations to the inner frame via the shock-absorber means. Consequently, the vibrations are noticeably reduced at the level of the inner frame 40 and therefore for the user. This may prove advantageous in terms of prevention of injuries such as musculoskeletal problems.

The assembly formed by the handle and the inner frame may be associated with different types of outer cover strip and/or different shock-absorbing materials. The cover strips may differ in terms of the following characteristics: geometry, hardness, stiffness, materials, dimensions, colors. The shock-absorbing materials may differ in terms of the following characteristics: geometry, hardness, stiffness, dimensions, thickness, number, materials, colors.

The remaining figures show a second embodiment of the invention. In these figures, reference numbers analogous to those of the preceding figures are increased by 100.

The racket of this variant differs from that described above in that the outer frame 142 extends from the handle in the conventional way. The section of this outer frame is then slightly narrower than that of a standard frame. Moreover, the inner frame 140 is of oval shape and incorporates the bridge 141. The outer frame 142 and the inner frame 140 are tubular.

In the example shown, the area of connection between the two frames extends over the whole of the periphery of the inner frame 140 except for the area forming the bridge 141. However, in a variant that is not shown the outer frame may extend over only a portion of the periphery of the inner frame. The outer frame is then formed of two branches each of which extends from the handle and covers a portion of a respective side of the strings inside. In this variant that is not shown, the mechanical connecting areas, corresponding to where the inner frame and the outer frame overlap, advantageously extend above the straight line D.

As in the first embodiment, elastomer blocks 150' and 150" are disposed between the facing faces 140' and 142' of the inner frame and the outer frame, respectively. Moreover, grommet strips 160 are disposed between the two frames. The blocks 150' and 150" are disposed between the outer face 140' of the inner frame 140 and the inner face 142' of the outer frame 142. The inner frame is therefore at a distance from the outer frame 142 and so the inner frame 140 and the outer frame 142 are not in direct contact.

The outer frame 142 is provided with orifices 142" each of which receives a grommet 166 that is part of a corresponding grommet strip 160. As in the first embodiment, the cross-section of these orifices 142" is substantially equal to the outer section of the grommets so that they are a force-fit in these orifices.

Moreover, the inner frame 140 is provided with complementary orifices 140" each of which receives a corresponding grommet 166. However, in contrast to the first embodiment, the orifices 142" have a cross-section substantially equal to the outer section of the grommets. Consequently, these grommets are a force-fit not only in the orifices 142" as explained above but also in the orifices 140". In other words, there is no longer any clearance between the orifices of the inner frame and the grommets, in contrast to the first embodiment.

As stated above, in this second embodiment the bridge area 141 that is part of the inner frame 140 is not directly supported by the outer frame 142. Consequently, when the ball is hit, the strung region of the frame, situated immediately above the bridge, does not transfer as much power as the same area of a standard racket.

This therefore makes it possible to homogenize the power area and thus to improve hitting quality. In standard rackets, the power transferred by a given area of the strings decreases in the direction of the top of the frame, which results in an overall imbalance in terms of the power provided, which is a drawback that the invention remedies.

According to an advantageous feature of this second embodiment, the grommets 166 of the grommet strips have a cross-section substantially equal to the outer section of the strings 112, which causes forced contact between a string and the grommet that receives it. Given these conditions, when hitting a ball, the strings caused to move in this way act on the above-mentioned grommets so that they come to bear against the oval inner frame 140. The vibrations are therefore transmitted from the strings to the inner frame and are then damped by the blocks disposed between the two frames 140 and 142.

In a variant that is not shown, only one of the inner and outer frames 140 and 142 is tubular.

Figure 6:
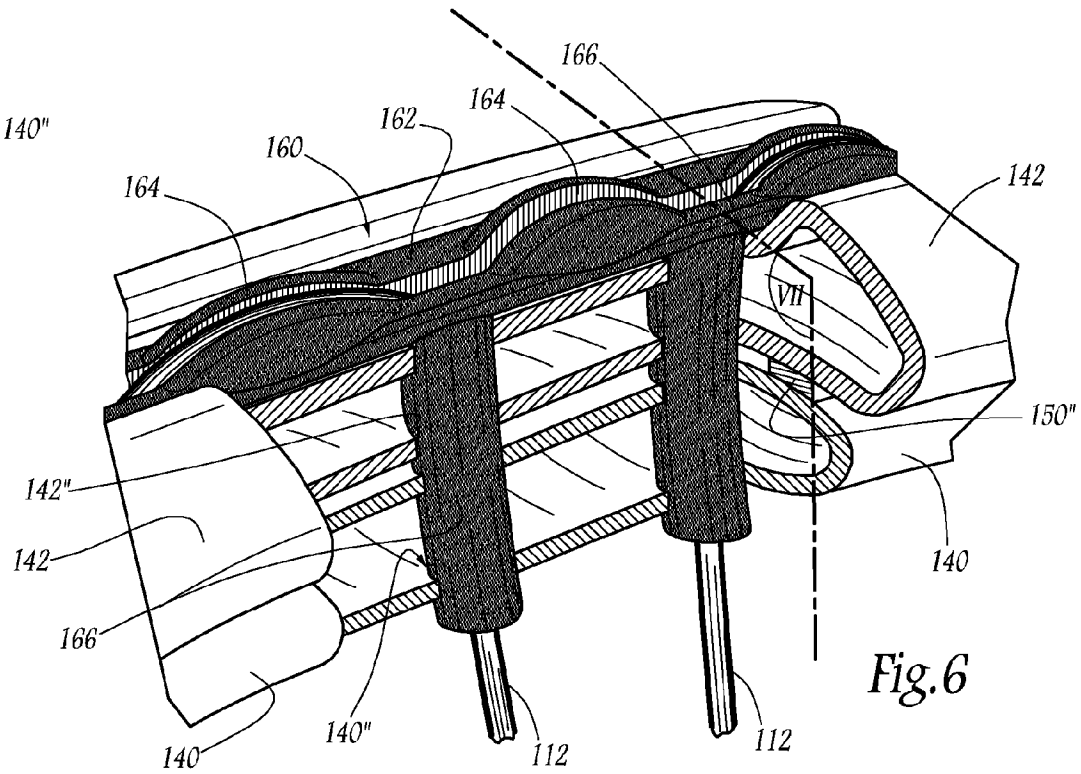
FIG. 6 is a cutaway perspective view analogous to FIG. 3 showing part of FIG. 5.
Figure 7:
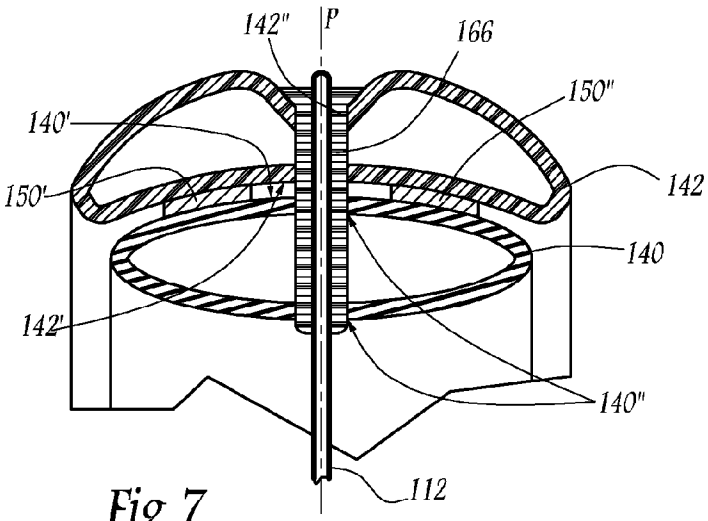
FIG. 7 is a view in cross-section in the plane VII in FIG. 6.

In a variant that is not shown, as an alternative to the embodiment of FIGS. 6 and 7, each grommet has an outer section substantially smaller than the section of a corresponding orifice formed in the outer frame and close to the section of a corresponding orifice formed in the inner frame. Thus each grommet is a force-fit only in the orifice of the inner frame. There is a clearance between the grommet and the respective orifice of the outer frame.

The invention claimed is:

1. A tennis racket comprising a handle, a frame defining a head of the racket, and two branches connecting the handle and the frame, wherein the frame includes an outer frame, an inner frame at a distance from the outer frame so that the inner frame and outer frame are not in direct contact, the inner frame being produced in one piece with the handle and the outer frame is a cover strip extending at an outer periphery of the inner frame, shock-absorber means disposed between an outer peripheral face of the inner frame and an inner peripheral face of the outer frame, and wherein the frame further includes at least one grommet strip including an elongate body that engages an outer face of the outer frame and at least one grommet through which passes a string that enters both first orifices provided in the inner frame and second orifices provided in the outer frame.

2. The racket according to claim 1, wherein at least one of the inner frame and the outer frame is tubular.

3. The racket according to claim 1, wherein both the inner frame and the outer frame are tubular.

4. The racket according to claim 1, wherein the outer cover strip is symmetrical relative to the head of the frame, over more than half the strings being inside the outer cover strip.

5. The racket according to claim 1, wherein each free end of the cover strip covers the inner frame so that all the horizontal strings to be stretched over the frame cooperate with the inner frame and the cover strip forming the outer frame.

6. The racket according to claim 1, wherein each grommet has an outer section close to that of a corresponding orifice provided in the outer frame so as to be a force-fit therein and each grommet has an outer section much smaller than that of a corresponding orifice provided in the inner frame so as to define a functional clearance between the grommet and the walls of this orifice.

7. The racket according to claim 1, including different cover strips and/or different shock-absorber means.

8. A tennis racket comprising a handle, a frame defining a head of the racket, and two branches connecting the handle and the frame wherein the frame includes an outer frame, an inner frame at a distance from the outer frame so that the inner frame and outer frame are not in direct contact, shock-absorber means disposed between an outer peripheral face of the inner frame and an inner peripheral face of the outer frame, and wherein the frame further includes at least one grommet strip including an elongate body that engages an outer face of the outer frame and at least one grommet through which passes a string that enters both first orifices provided in the inner frame and second orifices provided in the outer frame, and wherein the inner frame has an oval shape and incorporates a bridge of the frame and the outer frame extends from the handle and covers at least a portion of the outer periphery of the oval shaped inner frame.

9. The racket according to claim 8, wherein the outer frame covers a whole of the outer periphery of the oval inner frame.

10. The tennis racket according to claim 8, wherein each string has outer dimensions close to a cross section of a corresponding orifice that is part of the grommet in which each string lies.

11. The racket according to claim 8, wherein each grommet has a cross section close to a corresponding orifice provided in the outer frame and a corresponding orifice provided in the inner frame, so that the grommet is force-fit in both of the orifices in the inner and outer frames.

12. The racket according to claim 8, wherein each grommet has an outer cross section substantially smaller than a cross section of a corresponding orifice provided in the inner frame and close to a cross section of a corresponding orifice provided in the outer frame so that each grommet is force-fit in an orifice of the outer frame.

* * * * *